US005312298A

United States Patent [19]

Myers

[11] Patent Number: 5,312,298

[45] Date of Patent: May 17, 1994

[54] FLOOR VENT

[75] Inventor: Leroy Myers, Gig Harbor, Wash.

[73] Assignee: Vent Air, Inc., Vancouver, Wash.

[21] Appl. No.: 919,770

[22] Filed: Jul. 24, 1992

[51] Int. Cl.[5] ..... F24F 13/15

[52] U.S. Cl. ..... 454/290; 454/325

[58] Field of Search ..... 454/284, 290, 325, 335, 454/318, 319

[56] References Cited

U.S. PATENT DOCUMENTS

| | | | |
|---|---|---|---|
| 34,783 | 3/1862 | Sawyer | 454/290 X |
| 1,691,285 | 11/1928 | Helms . | |
| 3,176,715 | 4/1965 | McQuown | 454/319 X |
| 3,938,430 | 2/1976 | Koppang | 454/290 |
| 4,056,048 | 11/1977 | Milroy . | |
| 4,401,260 | 8/1983 | Grant . | |
| 4,413,774 | 11/1983 | Grant . | |
| 4,417,687 | 11/1983 | Grant | 454/290 X |
| 4,452,391 | 6/1984 | Chew . | |

FOREIGN PATENT DOCUMENTS

| | | | |
|---|---|---|---|
| 176936 | 7/1988 | Japan | 454/314 |
| 2-93560 | 12/1990 | Japan | 454/316 |
| 84358 | 4/1991 | Japan | 454/316 |
| 137450 | 6/1991 | Japan | 454/316 |
| 116337 | 4/1992 | Japan | 454/316 |

*Primary Examiner*—Harold Joyce

*Attorney, Agent, or Firm*—R. Reams Goodloe, Jr.

[57] ABSTRACT

Floor vents for alternately supplying air to a conditioned space. Such vents, used in combination with a heating or cooling system, facilitate the delivery of air in a desired direction. The plastic vent may be constructed of pigmented material in a desired color. Louvers with integrally formed gears are pivotally mounted between ends of the vent, and are repositioned by a thumbwheel located below the upper surface of the grille portion of the vent, to thereby avoid damage to the gear by foot traffic above the vent. The louvers are provided with integrally formed bushings and rotatable end elements to enhance rotation and reliability.

12 Claims, 4 Drawing Sheets

FIG. 1
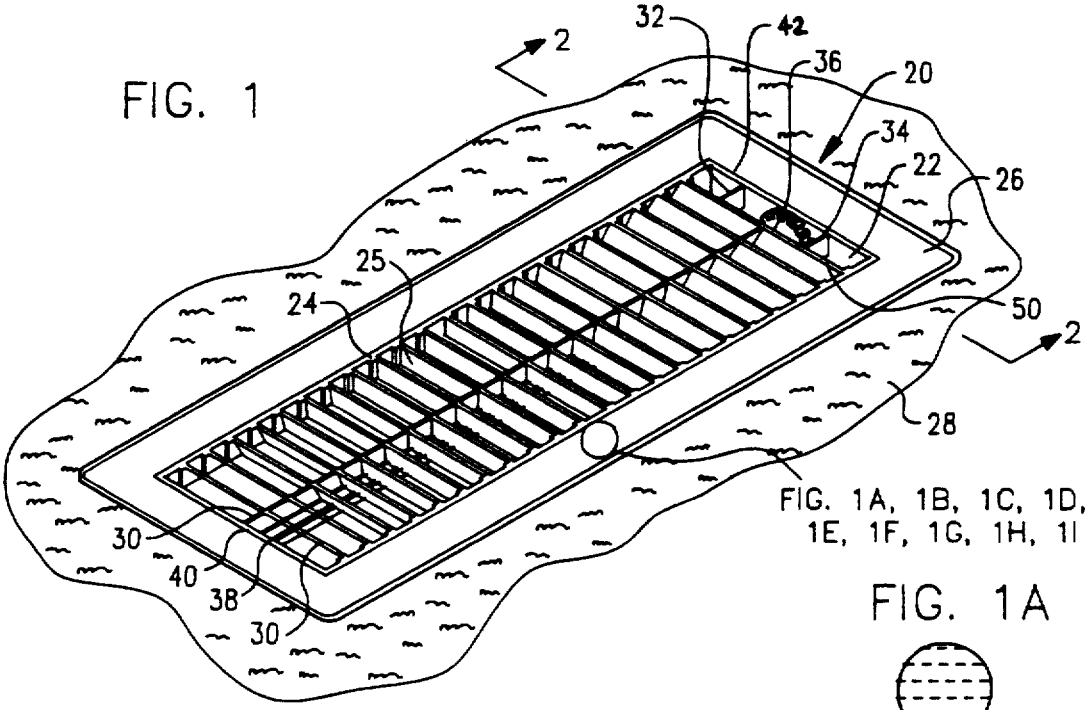
FIG. 1A, 1B, 1C, 1D, 1E, 1F, 1G, 1H, 1I
FIG. 1A
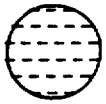
FIG. 1B
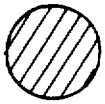
FIG. 1C
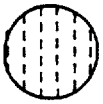
FIG. 1D
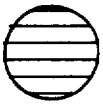
FIG. 1E
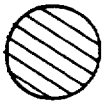
FIG. 1F
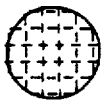
FIG. 1G
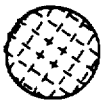
FIG. 1H
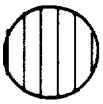
FIG. 1I
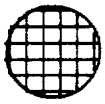
FIG. 2
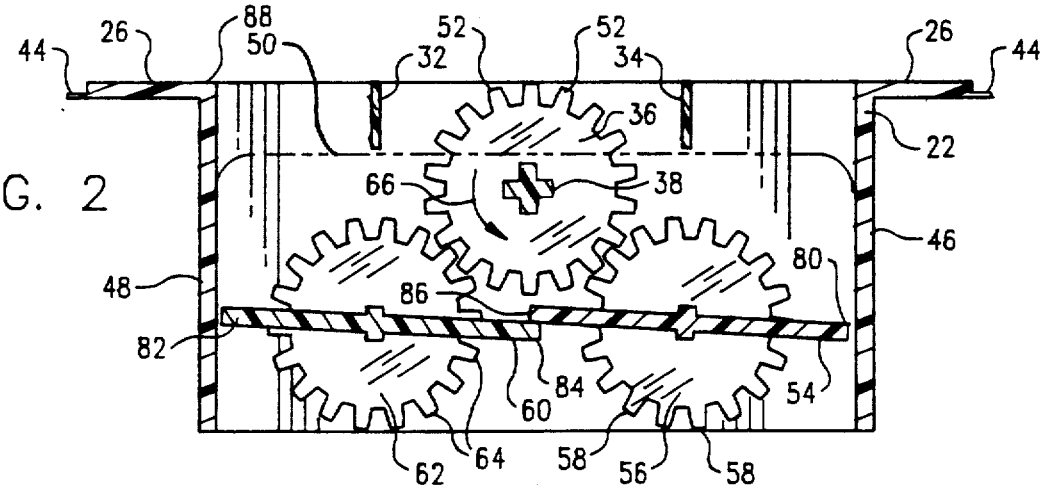

FLOOR VENT

TECHNICAL FIELD OF THE INVENTION

This invention relates to a novel, improved vent for conveniently diverting an air stream in a desired direction as it exits heating and/or cooling ductwork. Devices of that character are particularly useful as registers in residential and light commercial heating and cooling systems. Such devices are commonly located where ductwork penetrates either floors or walls; however, since floor use is most prevalent, such devices will for the most part be referred to herein as floor vents.

BACKGROUND OF THE INVENTION

A continuing demand exists for a simple, inexpensive, mechanically adjustable floor vent device which can be used to influence the direction of an air stream exiting a floor vent, as well as to regulate the amount of air which is exiting the vent. The need for such devices is commonly seen in conjunction with the use of residential central heating or cooling systems, where it is desirable to provide an attractive vent to direct the rising air stream.

As the air streams which course through floor vents contain to some limited degree certain amounts of debris, lint, and other contamination, vents typically accumulate over time such dirt or contamination. This dirt must be removed to improve the visual appearance of the floor vent, as well as to restore the airflow to the original design conditions.

Vent devices of the general character described above which provide the some of the aforementioned desired capabilities have heretofore been proposed. Those of which I am aware are disclosed in U.S. Pat. Nos. 34,783 issued Mar. 25, 1862 to Sawyer for IMPROVEMENT IN HOT-AIR REGISTERS; 1,691,285 issued Nov. 13, 1928 to Helms for HEAT REGISTER AND CUT-OFF FOR AIR HEATING SYSTEMS; 3,938,430 issued Feb. 17, 1976 to Koppang for AIR VENTS; 4,056,048 issued Nov. 1, 1977 to Milroy for EMERGENCY VENTILATION MEANS FOR CONFINED LIVESTOCK AREAS; 4,401,260 issued Aug. 30, 1983 to Grant for SELF-OPERATED AIR REGISTER DAMPER; 4,413,774 issued Nov. 8, 1983 to Grant for DIRECT DRIVE AIR REGISTER DAMPER; 4,417,687 issued Nov. 29, 1983 to Grant for MULTI-BLADE AUTOMATIC AIR REGISTER DAMPER; 4,452,391 issued Jun. 5, 1984 to Chow for AIR REGULATING DEVICE;

For the most part, the patent documents identified in the preceding paragraph disclose devices which include one or more louver portions, to which either manually adjustable or automatically adjusting devices are appended. Koppang, U.S. Pat. 3,938,430, discloses a device believed to be the closest to the present invention; however, his device utilizes opposing directional dampers, rather than parallel operating louvers as in the present invention. Further, his actuator is integrally molded with one of the louvers, rather than being independently operated as is the thumbwheel of the present invention. Also, his actuator protrudes above the top of the grill, thus exposing it to accidental breakage underfoot. Nor does his vent have centering wedges to help secure the vent within an opening.

Other prior art includes a variety of devices, many of which include a complicated assembly of components for operation. Such devices create an inherently unreliable operation the lifetime of a floor vent. Over time, various automatic machinery would likely deteriorate, thus necessitating repairs to maintain an efficiently operating air system.

Another common deficiency of the heretofore available floor vents is the absence of a variety of choices of colors in a vent, unless resort is had to painting the vent. The advantage of a vent readily available to be selected from a variety of colors to match a home or business color scheme is important and self-evident.

SUMMARY OF THE INVENTION

I have now invented, and disclose herein, certain novel, improved floor vents which do not have the above-discussed drawbacks common to those heretofore used floor vents of which I am aware. Unlike floor vents heretofore available, my vent is simple, relatively inexpensive, light, easy to install and remove for cleaning, and otherwise superior to the heretofore proposed ones.

My novel floor vent differs from those vents mentioned above in one respect in that they have a simple air flow diverting portion which can be operated in the open or air vent position, or which can be turned in parallel toward a closed or low to no air flow position. As a consequence the operator can elect to place the vent in the desired position by a simple rotation of a thumb wheel on the device, which turns the louvers via gears integrally molded with each louver. Further, the thumbwheel in my vents is located below the upper surface of the vents, thus eliminating the possibility of damage of the same by foot traffic across the vent. Additionally, my vents may be manufactured in pigmented plastics, so as to provide a color to match a given carpet or floor covering.

Aside from the foregoing, my novel floor vent devices are simple, durable, and relatively inexpensive to manufacture.

OBJECTS, ADVANTAGES, AND FEATURES OF THE INVENTION

From the foregoing, it will be apparent to the reader that one important and primary object of the present invention resides in the provision of novel, improved mechanical devices to provide a means for venting air through a roof or wall, thereby allowing easily adjustable directional control, while reducing or eliminating the possibility of damage to the control mechanism.

Other important but more specific objects of the invention reside in the provision of floor vents described in the preceding paragraph which:

- allow the adjustment of the vent to be done in a simple, one step manner;
- are relatively simple;
- are comparatively light;
- are relatively inexpensive;
- in conjunction with the preceding object, have the advantage that they can be removed from their operating location for easy cleaning;
- have a rotatably manipulable thumb wheel member with a first position at which the air louvers are open to allow normal air flow outward, and which by manual operation can be reset to a second position at which air flow is essentially restricted.

Other important objects, features, and additional advantages of my invention will become apparent to the reader from the foregoing and the appended claims and as the ensuing detailed description and discussion proceeds in conjunction with the accompanying drawing.

BRIEF DESCRIPTION OF THE DRAWING

In the drawing:

FIG. 1 is a perspective view of a floor vent constructed in accord with the principles of the present invention, shown in a floor adjacent to a carpet.

FIGS. 1A, 1B, 1C, 1D, 1E, 1F, 1G, 1H, and 1I represent alternate colors for the floor vent of the present invention.

FIG. 2 is a vertical cross sectional view, taken across section 2—2 of FIG. 1, showing the interlocking gear and thumbwheel mechanism to operate the louvers in the floor vent, with the louvers in the closed position.

DETAILED DESCRIPTION OF THE INVENTION

Figure 3:
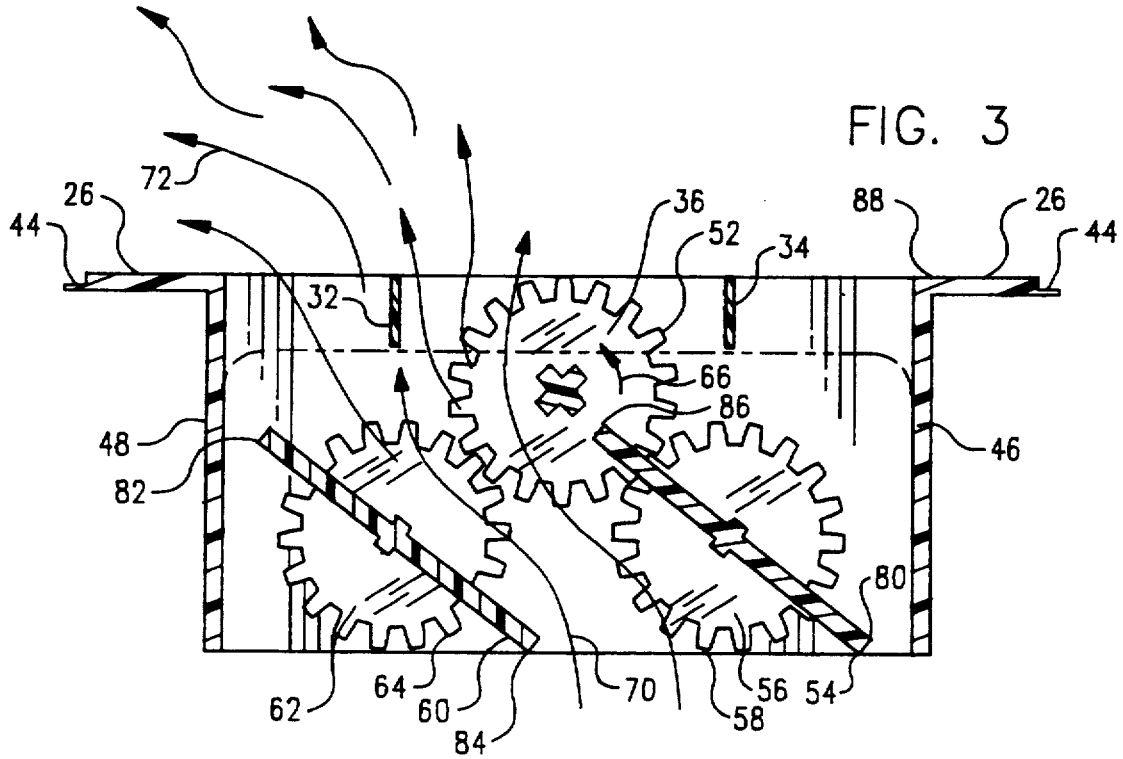
FIG. 3 is a vertical cross sectional view, similar to FIG. 2 and also taken across section 2—2 of FIG. 1, showing the interlocking gear and thumbwheel mechanism to operate the louvers with the louvers in a partially open position.

Referring now to the drawing, FIG. 1 depicts, in its operative position, a floor vent 20 constructed in accord with, and embodying, the principles of the present invention.

Major components of the floor vent 20 include: a generally rectangular housing portion 22, grille portion 24 including individual grille elements 25, and a planar flange 26 to fit over adjacent floor or carpet 28 so as to provide a pleasing visual appearance. Grille portion 24 includes a central stiffening bar 30, and stiffening ribs 32 and 34 adjacent to a louver adjusting thumbwheel 36.

Additionally visible in this FIG. 1 is a preferably stationary central stiffening bar 38, which runs from left end 40 of housing 32 to right end 42 of housing 32, and about which thumbwheel 36 rotates at on end thereof. Also, flange 26 may have a visually enhancing outer edge portion 44 to further cover adjacent carpet 28.

Floor vent 20 is advantageously manufactured of a machine washable plastic such as ABS or high density polypropylene which can be manufactured with inherently pigmented material of a desired color. FIG. 1A shows a gray or silver vent 20. FIG. 1B shows a brown vent 20; FIG. 1C shows a violet or purple vent 20; FIG. 1D shows a blue vent 20; FIG. 1E shows a green vent 20; FIG. 1F shows a yellow or gold vent 20; FIG. 1G shows an orange vent 20; FIG. 1H shows a red or pink vent 20; FIG. 1I may be a vent 20 of another desired color such as black.

The use of a machine washable, pigmented plastic type material is an important improvement over the prior art vents known to me. First, an important advantage is that painting may be eliminated for vents, unlike the situation commonly required with the heretofore available metal vents. This advantage reduces manufacturing and installation costs for my vents 20. Second, with a machine washable vent 20, a homeowner or maintenance worker may simply remove the floor vent and place it in a dishwasher, for example, to thoroughly clean the vent and return it to "like new" condition. Unlike metal vents, the plastic vent 20 described herein will not tend to rust as a result of such cleaning, nor will there be any paint on my plastic vent to become chipped or otherwise subject to wear or damage.

Also, with a pigmented plastic vent material, the homeowner or interior designer may simply select the floor vent of a desired color to match the floor covering or carpet, such as by use of color chips as is now done for other interior decorating products. This is an important advantage in that it gives the buyer a way to control the floor vent color, and to assure that the color selection of the floor vent is as desired.

Turning now to FIG. 2, a cross sectional view of the floor vent 20 is provided. Housing portion 22 is seen here to include opposing side walls 46 and 48. To show the size of first grille element 50, (to which ribs 32 and 34 connect) it is shown in broken lines in mirror image fashion in this FIG. 2.

Thumbwheel 36 is actually a rotatable toothed 52 gear. A first louver 54 having an integrally molded first louver gear portion 56 is shown with teeth 58 which engage teeth 52 of thumbwheel 36. A second louver 60 is shown having an integrally molded second louver gear portion 62 with teeth 64 which engage teeth 52 of thumbwheel 36.

Figure 4:
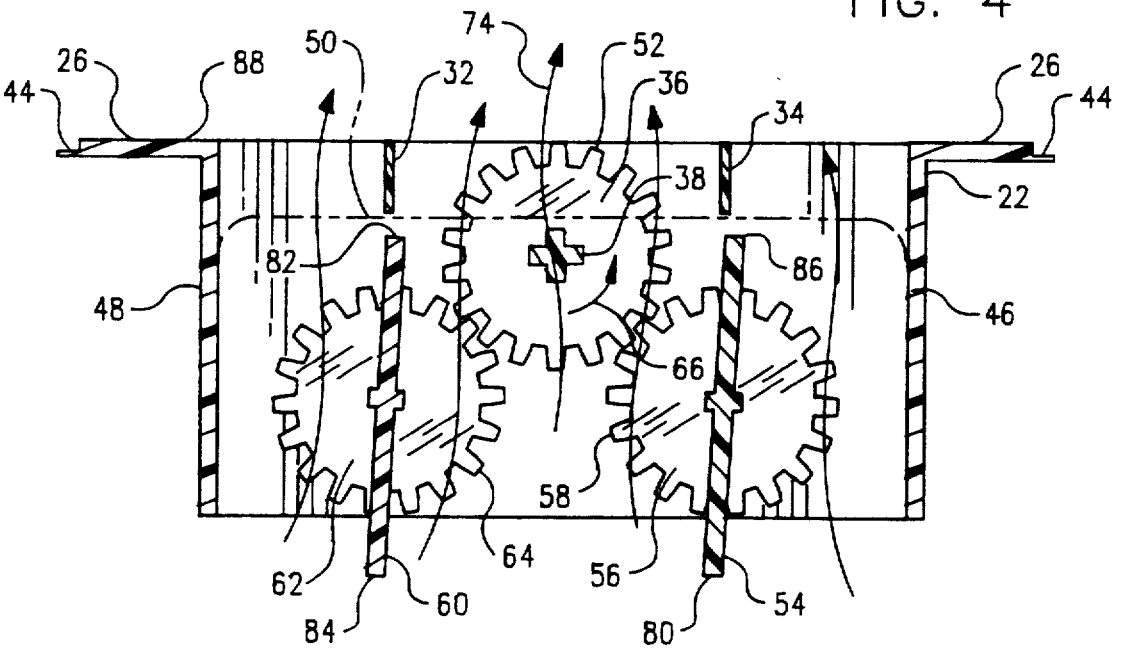
FIG. 4 is a vertical cross sectional view, similar to FIG. 2 and also taken across section 2—2 of FIG. 1, showing the interlocking gear and thumbwheel mechanism to operate the louvers in the floor vent, with the louvers in a fully open position.
Figure 5:
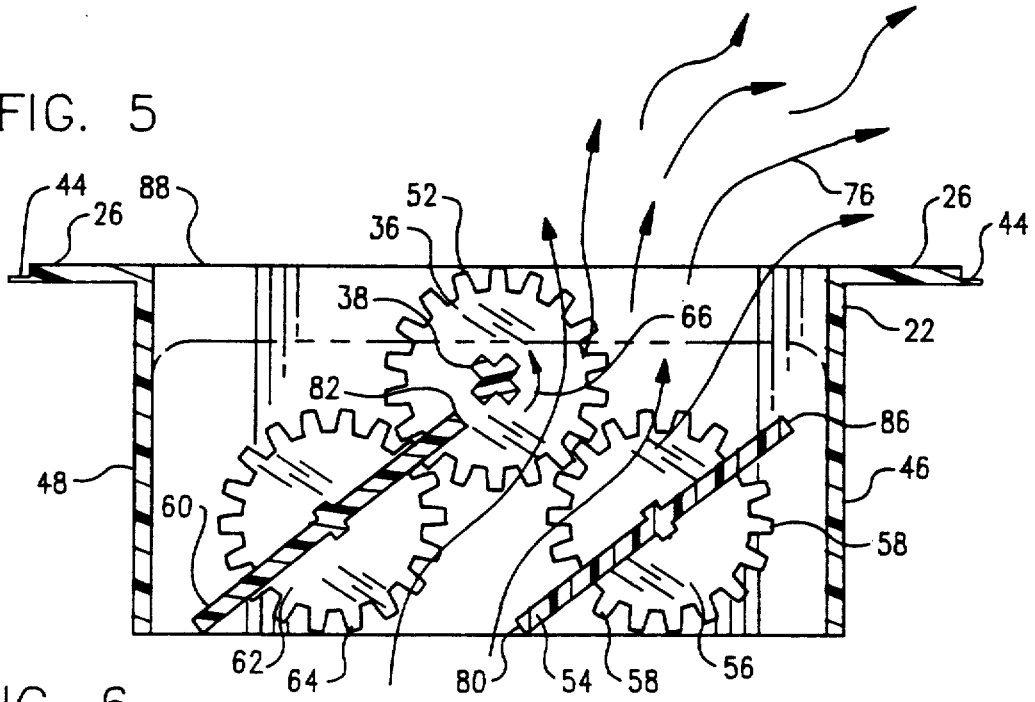
FIG. 5 is a vertical cross sectional view, similar to FIG. 2 and also taken across section 2—2 of FIG. 1, showing the interlocking gear and thumbwheel mechanism to operate the louvers in the floor vent, with the louvers in a partially closed position, similar to FIG. 3, but with the air flow in an opposing direction.

Attention is now directed to the series of FIGS. 2, 3, 4, and 5. As thumbwheel 36 is repositioned by rotating in the direction of arrow 66, louvers 54 and 60 are repositioned to a partially opened position as illustrated in FIG. 3. In this partially opened position, air flowing upward as indicated by arrow 70 is directed upward and outward in the direction of arrow 72. Continued rotation of thumbwheel 36 in the direction of arrow 66 as shown in FIG. 3 results next in the fully open position of louvers as illustrated in FIG. 4. In this situation, air flowing through vent 20 rises substantially vertically as indicated by arrow 74. Continued rotation of thumbwheel 36 in the direction of arrow 66 results in the louvers 54 and 60 being repositioned in a partially closed position, with airflow exiting rearward as indicated by arrow 76 in FIG. 5. Rotation of thumbwheel 36 will eventually stop when the first end 80 of louver 54 abuts and sealingly fits against second end 82 of louver 60 (not illustrated). This is similar (just reversing positions) to the opposite endpoint first illustrated in FIG. 2 above where the first end 84 of louver 60 abuts and sealingly fits against the second end 86 of louver 54.

Note in any of FIGS. 2 through 5 that the teeth 52 of thumbwheel 36 preferably do not extend above the upper edge 88 of flange 26. This is important since this avoids the possibility of damage to thumbwheel 36 or to gears 56 or 62 by the downward pressure of foot traffic across a floor vent.

As is more readily appreciated in FIG. 6 below, the rectangular housing portion 22 includes opposing sidewalls 46 and 46, and left and right ends 40 and 42 respectively.

Figure 6:
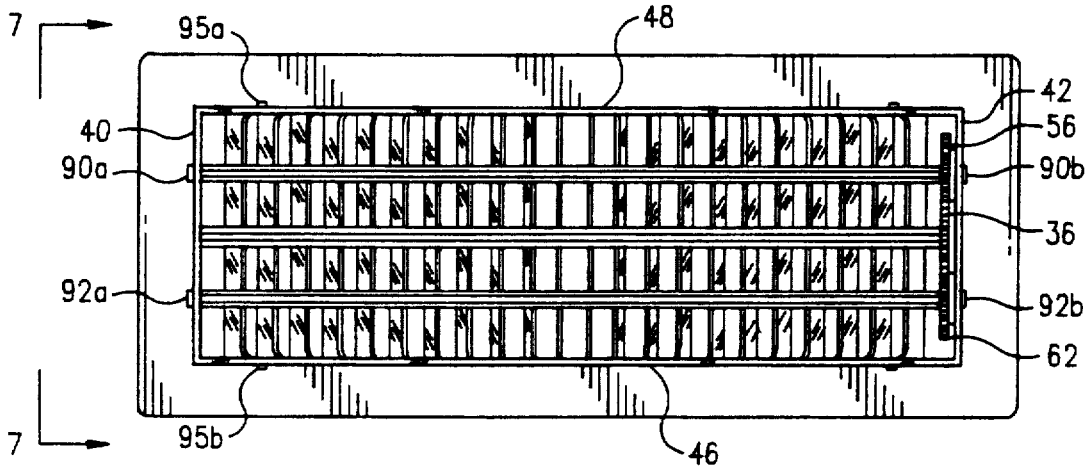
FIG. 6 is bottom view, looking upward from below the floor vent.

FIG. 6 also shows in full the louvers 54 and 60 with their integrally formed louver gears 56 and 62 respectively. Louvers 54 and 60 also comprise an integrally formed axle or pin 90 and 92, respectively, about which the louvers 54 and 60 are rotated. Pin 90 has a left end 90*a* and a right end 90*b*, and pin 92 has a left end 92*a* and a right end 92*b*.

Figure 7:
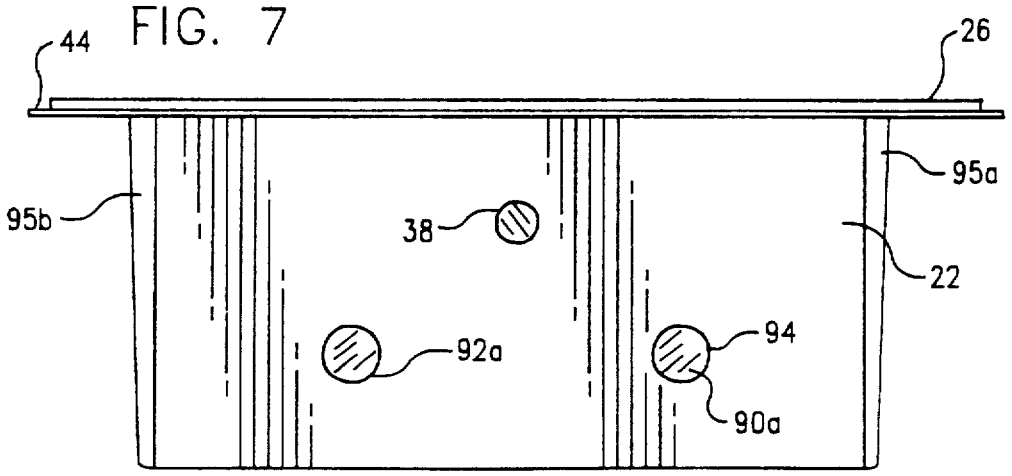
FIG. 7 is a left end view, taken as from 7—7 of FIG. 6.
Figure 9:
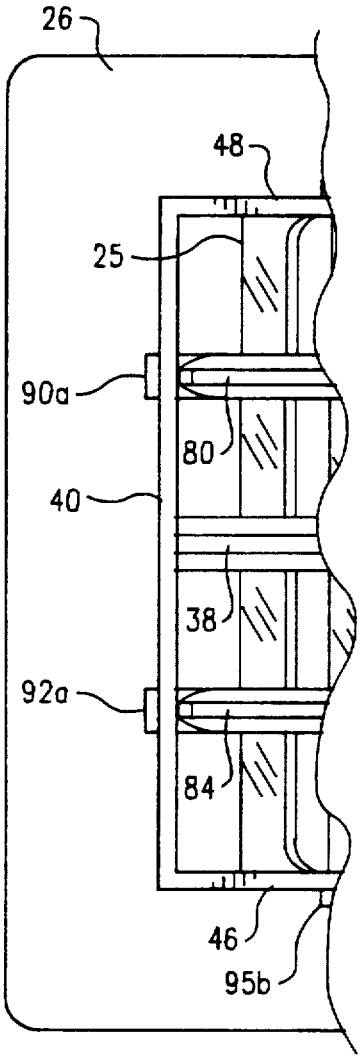
FIG. 9 is an enlarged view of the bottom right end of the floor vent, similar to the view first set

As can be seen in FIG. 7, which provides an end view of the left end of vent 20, left end 90*a* of pin 90 protrudes thru left side 40 of housing 22 and is located at an edge portion 94 defining an aperture thru wall 40 sized approximately the size of left end 90*a*. Pin end 92*a* is likewise situated and secured. This detail is further expanded in FIG. 9.

Also visible in FIG. 7 are wedge portions 95*a* and 95*b*, which are located on the outer edge 48*a* of wall 48, and on the outer edge 46*a* of wall 46. The wedge portions 95*a* and 95*b* operate to secure the vent in the preselected slot in a floor or wall.

Figure 8:
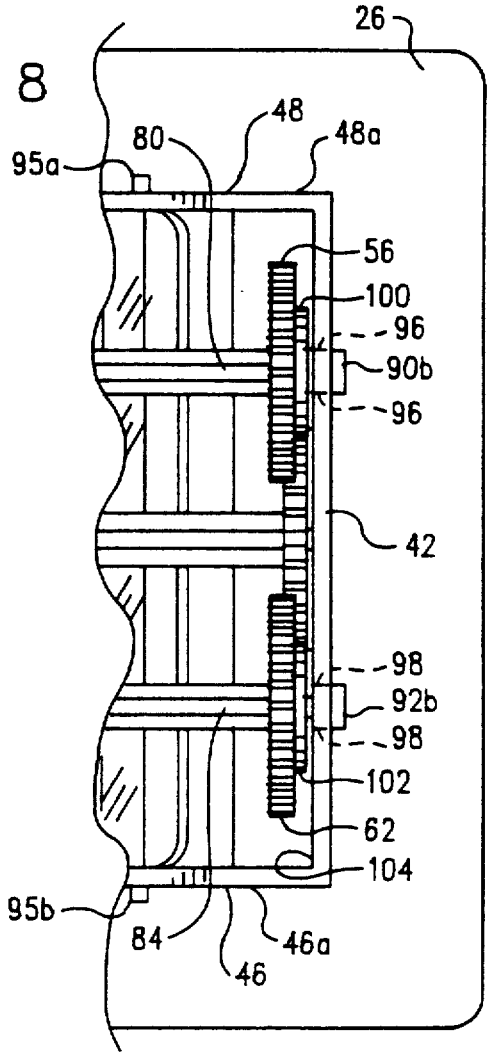
FIG. 8 is an enlarged view of the bottom left end of the floor vent, similar to the view first set forth in FIG. 6 above.

Turning now to FIG. 8, it can be seen in this enlarged bottom view showing the right end 42 of housing 22, that pin ends 90*b* and 92*b* are similarly situated by fitting the pin ends through the right end 42 of housing 22 and rotatably securing the pin ends in snug fitting apertures defined by broken lines 96 and 98 respectively. Also visible in FIG. 8 are preferably cylindrical integrally molded bushings 100 and 102 which are formed adjacent with louver gears 56 and 62 respectively. Bushings 100 and 102 afford spacing of gears 56 and 62 from the inside 104 of end 42, thus reducing friction of gears 56 and 62 against the interior wall 104.

Figure 10:
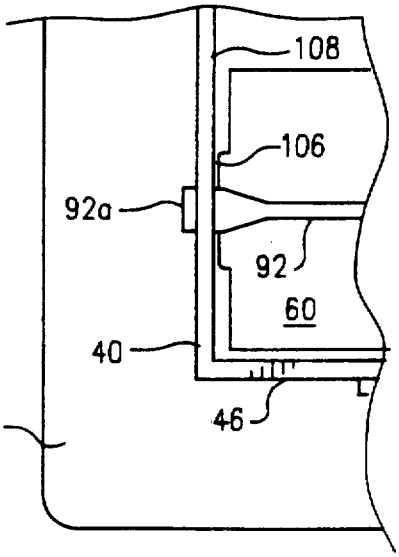
FIG. 10 is a partial bottom view of a floor vent, showing the left end of a louver and an axial pin protruding through the left end of the housing of the vent.

In FIG. 10, a partial bottom view of a vent 20 with louver 60 in the closed position is illustrated. Here, it can be seen that a rotating edge 106 is provided on louver 60 so as to extend louver 60 away from interior 108 of left wall 40 of housing 22. This edge 106 preferably extends radially outward from pin 92 by about one additional pin diameter, although the exact dimensions are not critical.

The axial movement of the louvers 54 and 60 relative to outlet portion grille 25 and housing 22 may be by any predetermined angle which is convenient in the fabrication of the louvers 54 and 60, but ranges essentially from zero (0) degrees when the louvers are in a vertical position, to almost ninety (90) degrees when the louvers are in the horizontal or closed position as seen in FIG. 2.

It will be readily apparent to the reader that the present invention may be easily adapted to other embodiments incorporating the concepts taught herein and that the present Figures are shown by way of example only and not in any way a limitation. As to embodiments illustrated in the above figures, like parts have been noted with common reference numerals without further discussion thereof.

It is clear from the heretofore described Figures that the floor vent 20 of the present invention provides a simple vent which may be easily manually rotated between operating positions. Further, the plastic vent may be manufactured in a variety of colors, and may be easily removed for cleaning or washing.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description; and all changes which come within the meaning and range of equivalences of the claims are therefore intended to be embraced therein.

What is claimed is:

1. A vent for regulating the passage of air, adapted to be mounted in a floor or wall opening, comprising:

a housing member, said housing having opposing sidewalls and left and right end walls;

a grille portion, said grille portion including a plurality of grilles adapted for passage of air through gaps therebetween;

a first and a second louver, said first and second louvers pivotally mounted between said left and right end walls, said first and second louvers each further comprising integrally molded gear members said louvers adapted to deflect the flow of air impinging thereon; and a thumbwheel gear pivotally mounted between said left and right end walls, said thumbwheel gear adapted to rotatably engage said gear member of said first louver and said gear member of said second louver, said thumbwheel manually adjustable to rotating said first and second louvers between a forwardly closed position and a rearwardly closed position, and wherein said first and second louvers may be positioned in an open position intermediate between said forwardly closed and said rearwardly closed positions.

2. The apparatus of claim 1, wherein said housing includes an upper flange portion having an upper surface, and wherein said thumbwheel gear further includes gear teeth, and wherein said thumbwheel gear is pivotally mounted so that said gear teeth do not extend upwardly above said upper flange portion.

3. The apparatus of claim 1, wherein said integrally molded gear members further comprise an integrally molded bushing.

4. The apparatus of claim 1, wherein said louvers have a first end and a second end, and where said gear members are integrally molded on said first end, and where a rotating edge is integrally molded on said second end.

5. The apparatus of claim 1, wherein said louvers are positioned and move in a generally parallel relationship, so as to tend to deflect air impinging thereon in a generally uniform direction upon leaving said grille.

6. The apparatus of claim 1, wherein said grille portion further includes a center stiffening portion.

7. The apparatus of claim 6, wherein said grille portion further includes at least one offset stiffening rib adjacent to said thumbwheel.

8. The apparatus of claim 1, wherein said vent color is selected from one of the following:

(a) red or pink;
(b) brown;
(c) violet or purple;
(d) green;
(e) blue;
(f) gray or silver;
(g) orange;
(h) yellow or gold;
(i) black.

9. A floor vent suitable for directing air flowing therethrough, comprising:

a housing having opposing vertical sidewalls and vertical left and right ends;

a pair of integrally formed louvers pivotally located between said left and said right ends, said louvers each further comprising an integrally formed gear portion;

a thumbwheel pivotally located between said left and said right ends, said thumbwheel including a gear portion for rotatably engaging the gear portion of each of said pair of louvers, said thumbwheel adapted for selectively positioning said louvers, and wherein said louvers are adjustable in a generally parallel relationship from an angle of zero degrees to an angle of substantially ninety degrees relative to said vertical sidewalls, so as to direct airflow through said vent in a desired direction, or, alternatively, to substantially limit air flow thru said vent.

10. The apparatus as set forth in claim 1 or 9, wherein said vent further includes a planar flange portion.

11. The apparatus as set forth in claim 10, wherein said flange portion further includes an outer edge portion.

12. The apparatus as set forth in claim 1 or 9, wherein said grille portion includes a first subset of grilles oriented in a first direction, and a second subset of of grilles oriented in a second direction.

* * * * *

UNITED STATES PATENT AND TRADEMARK OFFICE
CERTIFICATE OF CORRECTION

PATENT NO. : 5,312,298

DATED : May 17, 1994

INVENTOR(S) : Myers, Leroy

It is certified that error appears in the above-identified patent and that said Letters Patent is hereby corrected as shown below:

In column 1, line 33, after "provide" delete "the".

In column 2, line 1, after "operation" insert --during--.

In column 3, line 32, after "FIG. 6 is" insert --a--.

In column 3, line 40, after "vent" insert a period --.--.

In column 3, line 40, after "vent" delete "similar to the view first set".

In column 3, line 61, delete "on" and insert --one--.

In column 5, line 5, delete "46" (second occurrence) and insert --48--.

In column 6, line 19, after "gear members" insert a comma --,--.

In column 8, line 12, delete "of" (second occurrence).

UNITED STATES PATENT AND TRADEMARK OFFICE
CERTIFICATE OF CORRECTION

PATENT NO. : 5,312,298

DATED : May 17, 1994

INVENTOR(S) : Myers, Leroy

It is certified that error appears in the above-identified patent and that said Letters Patent is hereby corrected as shown below:

In column 6, line 27, delete "rotating" and insert --rotate--.

Signed and Sealed this

Twentieth Day of May, 1997

*Attest:*

Bruce Lehman

BRUCE LEHMAN

*Attesting Officer*

*Commissioner of Patents and Trademarks*